US008297187B2

(12) United States Patent
Sullivan

(10) Patent No.: US 8,297,187 B2
(45) Date of Patent: Oct. 30, 2012

(54) IMPACT LOCATING DAY AND NIGHT MARKER FOR A PROJECTILE

(75) Inventor: Kevin Michael Sullivan, Kennebunk, ME (US)

(73) Assignee: Rheinmetall Waffe Munition GmbH, Unterluess (DE)

( * ) Notice: Subject to any disclaimer, the term of this patent is extended or adjusted under 35 U.S.C. 154(b) by 197 days.

(21) Appl. No.: 12/834,223

(22) Filed: Jul. 12, 2010

(65) Prior Publication Data

US 2012/0227614 A1 Sep. 13, 2012

Related U.S. Application Data

(60) Provisional application No. 61/271,452, filed on Jul. 21, 2009.

(51) Int. Cl.
*F42C 13/02* (2006.01)

(52) U.S. Cl. ..... 102/213; 102/502; 102/367; 102/370; 102/477; 102/529; 102/444

(58) Field of Classification Search ..... 102/513, 102/502, 367, 370, 477, 529, 444
See application file for complete search history.

(56) References Cited

U.S. PATENT DOCUMENTS

| | | | | |
|---|---|---|---|---|
| 4,505,200 | A * | 3/1985 | Bush | 102/293 |
| 5,565,649 | A | 10/1996 | Tougeron et al. | |
| 5,590,886 | A * | 1/1997 | Lush | 473/577 |
| 5,654,524 | A | 8/1997 | Saxby | |
| 6,065,404 | A * | 5/2000 | Ripingill et al. | 102/498 |
| 6,155,174 | A * | 12/2000 | Hervieu et al. | 102/513 |
| 6,497,181 | B1 | 12/2002 | Manole et al. | |
| 6,619,211 | B1 * | 9/2003 | Haeselich | 102/513 |
| 6,990,905 | B1 | 1/2006 | Manole et al. | |
| RE40,482 | E * | 9/2008 | Haeselich | 102/513 |
| 7,784,455 | B1 * | 8/2010 | Chong | 124/73 |
| 2006/0032393 | A1 * | 2/2006 | Haeselich | 102/502 |
| 2008/0053330 | A1 | 3/2008 | Haeselich | |
| 2011/0168049 | A1 * | 7/2011 | Williams et al. | 102/513 |

FOREIGN PATENT DOCUMENTS

| | | |
|---|---|---|
| EP | 1 183 494 | 2/2003 |

* cited by examiner

*Primary Examiner* — Samir Abdosh
(74) *Attorney, Agent, or Firm* — Karl F. Milde, Jr.; Eckert Seamans Cherin & Mellott, LLC

(57) ABSTRACT

A marking projectile comprises separate compartments that break during launch due to rotation of the projectile as it leaves the barrel of a weapon. Metal pellets contained within the compartments are pressed outward and pierce the compartment walls. This allows for mixing of chemical materials contained within the compartments, so that the materials substantially react by the time the projectile strikes a target. The chemical materials may be a pair of chemi-luminescent components, or components that create heat for thermal marking.

12 Claims, 7 Drawing Sheets

IMPACT LOCATING DAY AND NIGHT MARKER FOR A PROJECTILE

CROSS-REFERENCE TO RELATED APPLICATION

This application claims priority from Provisional Patent Application No. 61/271,452, filed Jul. 21, 2009.

BACKGROUND OF THE INVENTION

The present invention relates to the field of practice ammunition and, specifically, to an ammunition projectile that can mark its point of impact both by day and by night.

More particularly, the invention concerns a device, incorporated into a projectile, that provides for marking the point of impact of the projectile when the projectile strikes a target. As used herein, the term "projectile" is intended to include both mortar ammunition and artillery ammunition.

Impact marking projectiles are well known in the art. Marking projectiles which use a dry powder, such as a red powder dye, for marking the impact by day are known, for example, from the U.S. Patent Publication No. 2006/0032393 to Haeselich. Marking projectiles which use chemi-luminescent materials for marking their impact by night are also known. Reference is made, for example, to the U.S. Pat. No. 6,619,211 and the aforementioned Patent Publication, both to Haeselich, which disclose such practice ammunition. U.S. Pat. Nos. 6,497,181 and 6,990,905 to Manole et al. also disclose similar devices.

The aforementioned U.S. Pat. No. 6,619,211 was reissued as U.S. Pat. No. RE 40,482. This reissue patent discloses and claims an ammunition projectile containing two chemi-luminescent components which are mixed on set-back; that is, upon the initial acceleration of the projectile. The components, which are liquid, are contained in separate frangible compartments within the projectile that are designed to be broken by the acceleration and/or centrifugal forces when the projectile is fired from a weapon. When mixed, the liquid components react and produce a luminescent glow. When the projectile impacts a target the mixed chemi-luminescent material is released and dispersed to mark the point of impact. The projectile has a translucent ogive so that it can also emit light during flight.

The Haeselich reissue patent, referred to above, discloses two compartments, arranged either side by side or one above the other in the projectile, with a frangible partition between them. While this arrangement is satisfactory under most conditions, it is not fully reliable in that the frangible partition can sometimes withstand the acceleration and centrifugal forces experienced during launch, so that it does not break and allow mixing of the components.

SUMMARY OF THE INVENTION

A principal object of the present invention is to provide a marking device for a projectile which reliably marks the point of impact with a target.

A further object of the present invention is to provide a day and night marking device for a projectile which reliably mixes at least two liquid chemical components when the projectile is launched, so that the mixed material has substantially reacted by the time the projectile impacts a target.

These objects, as well as further objects which will become apparent from the discussion that follows are achieved, in accordance with the present invention, by designing the frangible compartments in such a way that, instead of (or in addition to) utilizing the forces at acceleration set-back to mix the liquid chemical components, they utilize centrifugal forces to initiate mixing. Upon launch of the projectile, the projectile rotation that is induced by lands and grooves in the barrel of the weapon imparts a centrifugal force on one or more masses that are suspended in the chemical components disposed within their respective compartments. The resulting outward motion of the masses causes them to penetrate the foil packaging material of the compartments, releasing the liquid into a surrounding medium, which may, for example, be a dry powder. This medium provides for even distribution of the reacting liquid while the projectile is in flight.

More particularly, the present invention relates to a training projectile having (1) a cartridge shell with a propulsion chamber containing a propellant charge, and (2) a hollow projectile body inserted in the cartridge shell.

According to the invention, the projectile body includes the following four elements:

(a) A projectile head designed to withstand the forces applied when the projectile is fired from a weapon and having a frangible ogive designed to burst when the projectile strikes a target.

(b) A plurality of frangible, compartments made of foil and disposed in the head substantially symmetrically about the central axis of rotation. The compartments are designed to be broken by the centrifugal forces acting on the projectile when the projectile is fired from a weapon.

(c) At least one marking agent disposed in the projectile head for marking the position of the projectile upon striking a target when the ogive has burst. This marking agent has two liquid components, each disposed in a separate one of the compartments in the head. These components are mixed and react chemically with each other when the compartments are broken, causing the mixed components to substantially react by the time the projectile strikes the target.

(d) At least one mass disposed in each separate one of the compartments together with a respective one of the chemical components. Each mass is denser than the liquid component in its respective compartment and serves to break the compartment due to the centrifugal forces that act on the projectile when the projectile is fired from a weapon.

In a preferred embodiment of the present invention, the masses disposed in each of the compartments are metal pellets and a carrier surrounds the compartments to receive the mixed chemical components when the compartments are broken.

The carrier preferably comprises a dry, fine powder of low density which may also serve as a second marking agent. This powder material, or other dry powder material, is disposed in a separate compartment in the projectile head and is designed to create a plume for daytime marking of a target when the projectile strikes the target and the ogive bursts.

The liquid chemical components of the marking agent are preferably either chemi-luminescent or exothermic, or both.

The literature is replete with examples of liquid chemi-luminescent materials. See, for example, U.S. Pat. No. 5,348,690. Those components, when mixed, create a luminescent glow.

Examples of liquid chemical components which, when mixed, create heat (called exothermic reactions) include (1) hydration of anhydrous salts, for example water and anhydrous calcium chloride or copper sulfate, and (2) liquid components that create polymerization reactions, such as the catalyzed polymerization of mono-methacrylate.

The training projectile may additionally also comprise a third marking agent that includes a plurality of second chemical components, each received in a separate compartment in the projectile head. These second components are also mixed and react chemically with each other, due to the initial acceleration and/or centrifugal forces acting on the projectile when the projectile is fired from a weapon. This causes the mixed second components to also mark the point of impact when the projectile strikes the target.

If the second chemical components are chemi-luminescent, for example, the third chemical components are preferably exothermic and create heat for thermally marking a target when the projectile strikes the target.

The marking device of the present invention is thus incorporated into a projectile and includes:

1. A projectile ogive or hood constructed of frangible material.
2. A frangible ogive which includes a void.
3. A frangible foil container having multiple compartments within the void, wherein:
   3.1 The compartments are filled with reactive chemicals to create chemical luminance, or create heat (NIR radiation), when mixed, and
   3.2 the compartments each contain one or more dense penetrating masses, which are
   3.3 uniformly positioned about the projectile's center of rotation.
4. A medium surrounding the foil container; and
5. Other marking compounds or similar materials.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
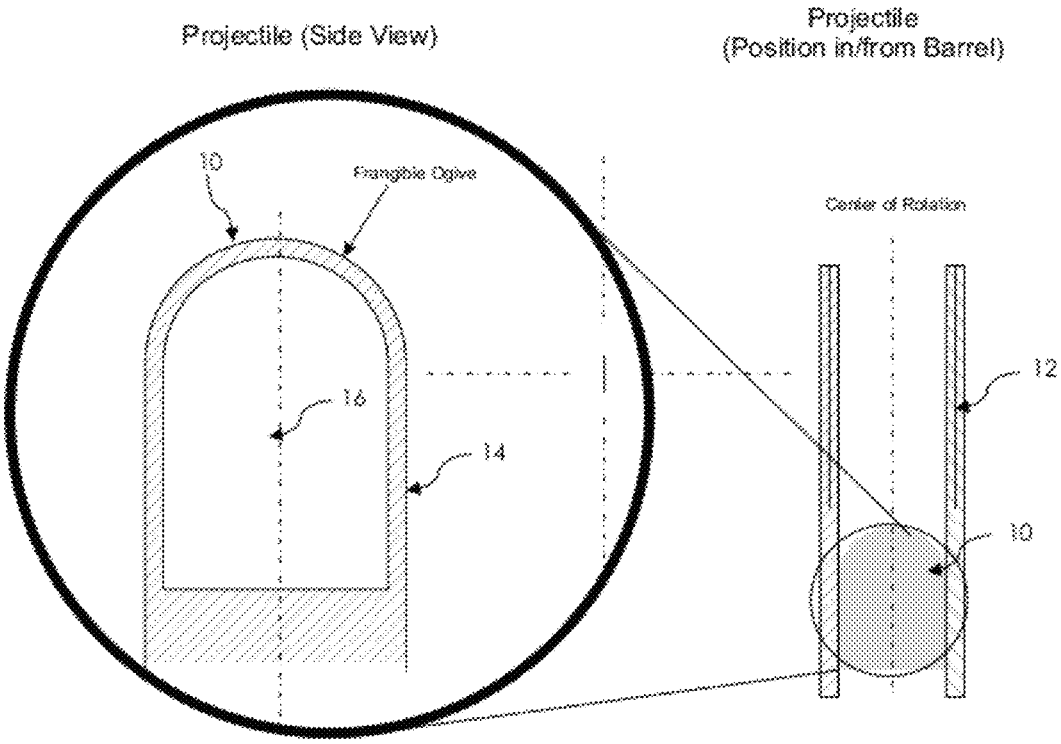
FIG. 1 is a representational diagram showing a hollow projectile disposed in the chamber of a weapon prior to firing.

The preferred embodiments of the present invention will now be described with reference to FIGS. 1-7 of the drawings. Identical elements appearing the various figures are designated with the same reference numerals.

FIG. 1 shows a projectile 10 disposed in the chamber of a weapon with a barrel 12, prior to firing and setback. As illustrated in the exploded and cross-sectional view, the projectile 10 comprises a hollow projectile body 14 having a void 16 at the projectile head.

Figure 2:
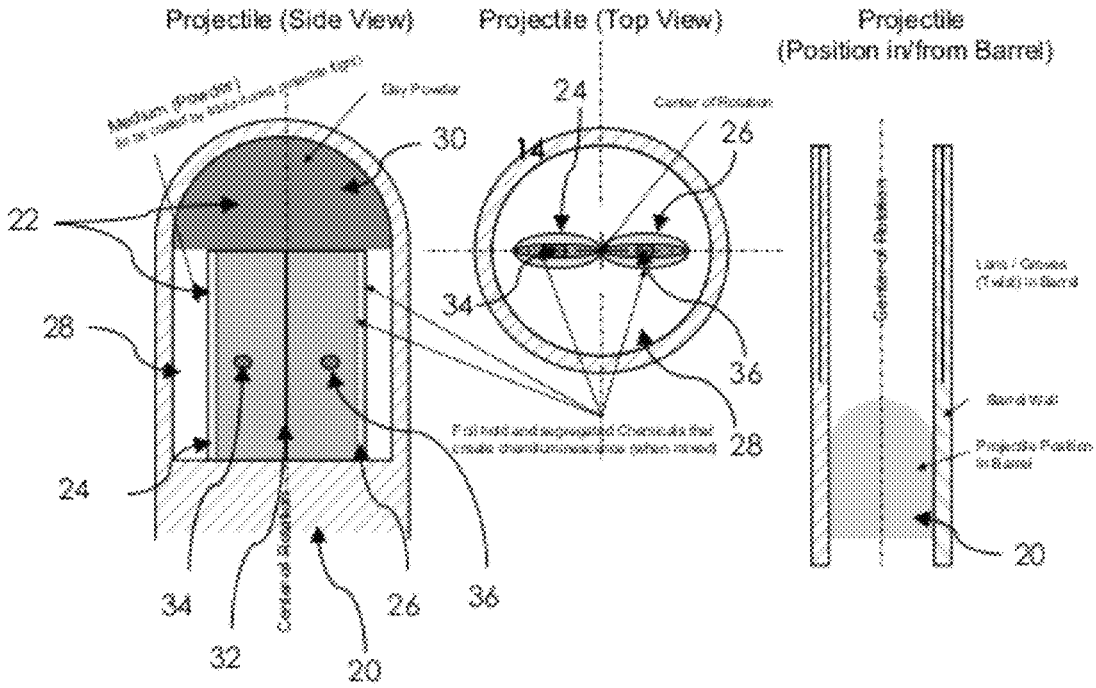
FIG. 2 is a representational diagram showing a projectile in the chamber of a weapon, which projectile incorporates a marking device according to the preferred embodiment of the invention.

FIG. 2 shows a projectile 20 having a marking device 22 in accordance with the preferred embodiment of the present invention, disposed in the projectile head. This marking device comprises four elements:

1. A pair of adjacent compartments 24 and 26 formed of frangible foil, each containing a separate liquid component such that, when the two components are mixed together, they chemically react. These components are preferably either chemi-luminescent or exothermic, or both.

The two compartments 24 and 26 are disposed substantially symmetrically about the center of rotation 32 of the projectile.
2. A dry medium 28, such as a fine powder, surrounding the foil compartments 24 and 26.
3. A red dye powder 30 disposed in the ogive of the projectile which, when released, forms a plume and serves as a day marker of the point of impact of the projectile.
4. A small pellet 34 and 36, disposed within each compartment 24, 26 respectively, which is suspended in the liquid component within each compartment.

The pellets 34 and 36 are preferably made of a relatively dense metal, such as lead.

Figure 3:
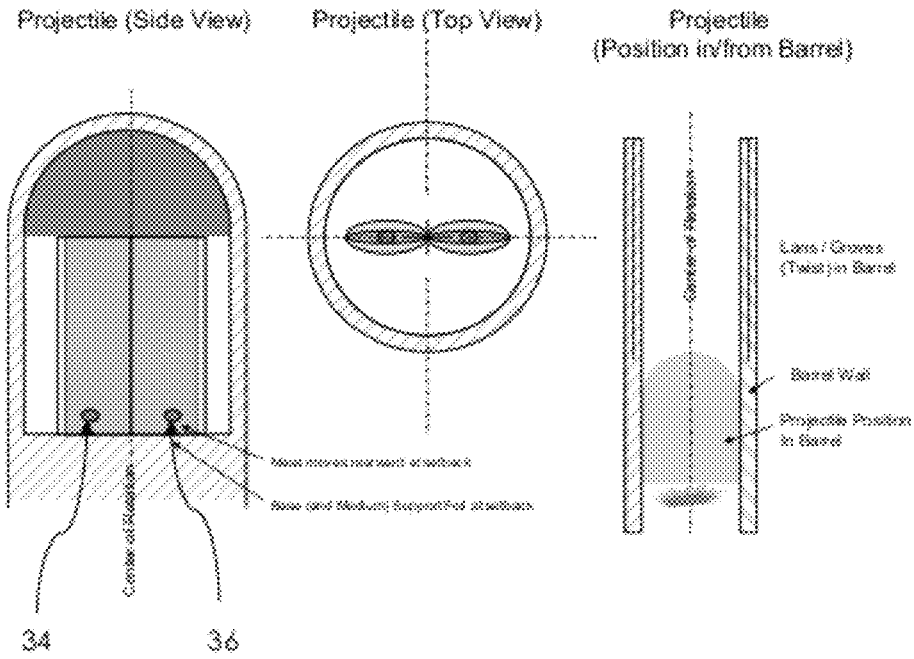
FIG. 3 is a representational diagram of the projectile of FIG. 2 during setback and immediately after firing in a weapon.
Figure 4:
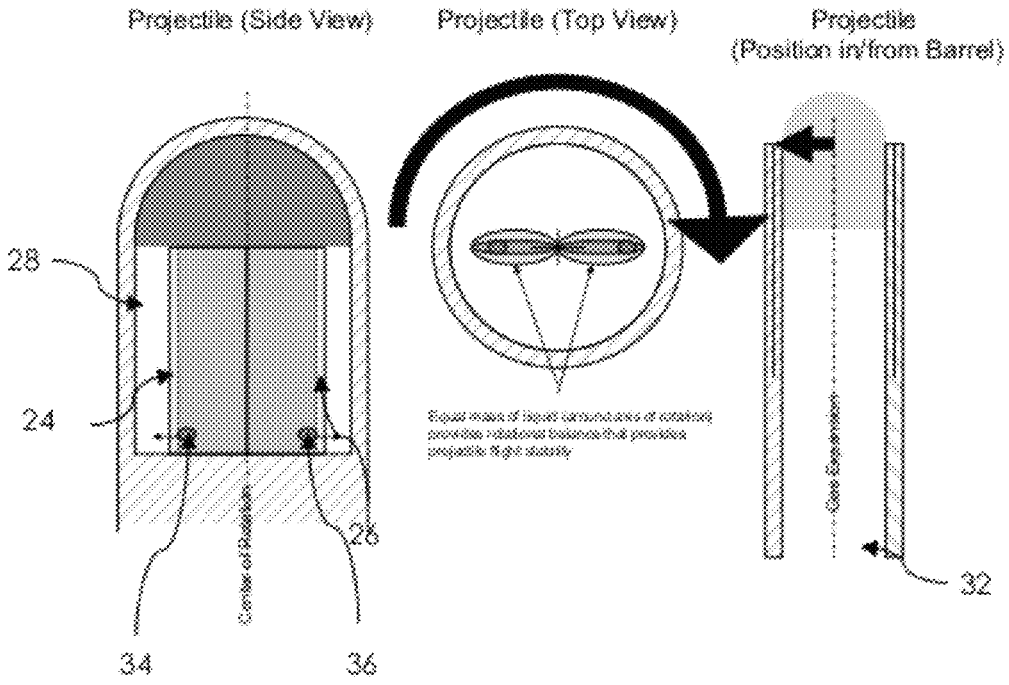
FIG. 4 is a representational diagram of the projectile of FIG. 2 as it begins to emerge from the barrel of the weapon.

Immediately upon firing, as shown in FIG. 3, the acceleration of the projectile causes the pellets 34 and 36 to move rearward in the projectile within the liquid component. As the projectile moves forward within the barrel, the lands and grooves on the inner wall of the barrel cause the projectile to rotate about its longitudinal axis 32. The centrifugal force resulting from this rotation causes the pellets 34 and 36 to move outward, as is illustrated in FIG. 4.

Figure 5:
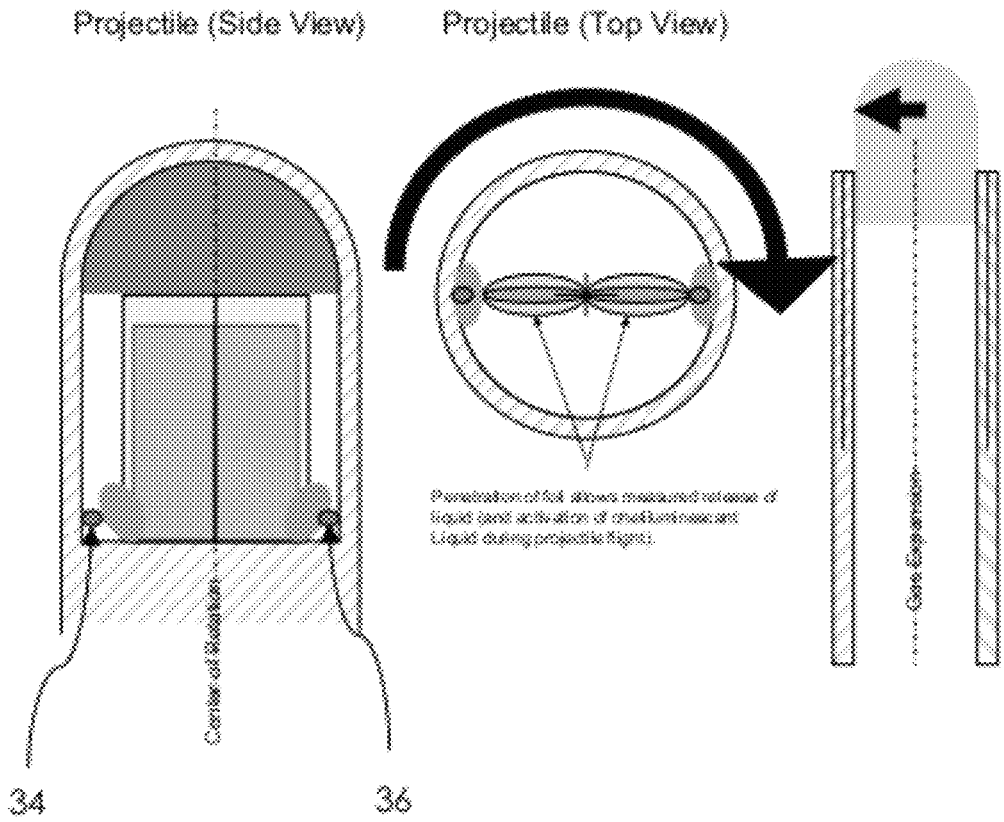
FIG. 5 is a representational diagram of the projectile of FIG. 2 as it has almost entirely emerged from the barrel of the weapon.

By the time the projectile emerges from the barrel, the pellets 34 and 36 have punctured the foil 24 and 26, respectively, encasing the two compartments, allowing the chemical components within the compartments to disperse into the surrounding dry powder medium 28 and mix together so that they chemically react. This is illustrated in FIG. 5.

Figure 6:
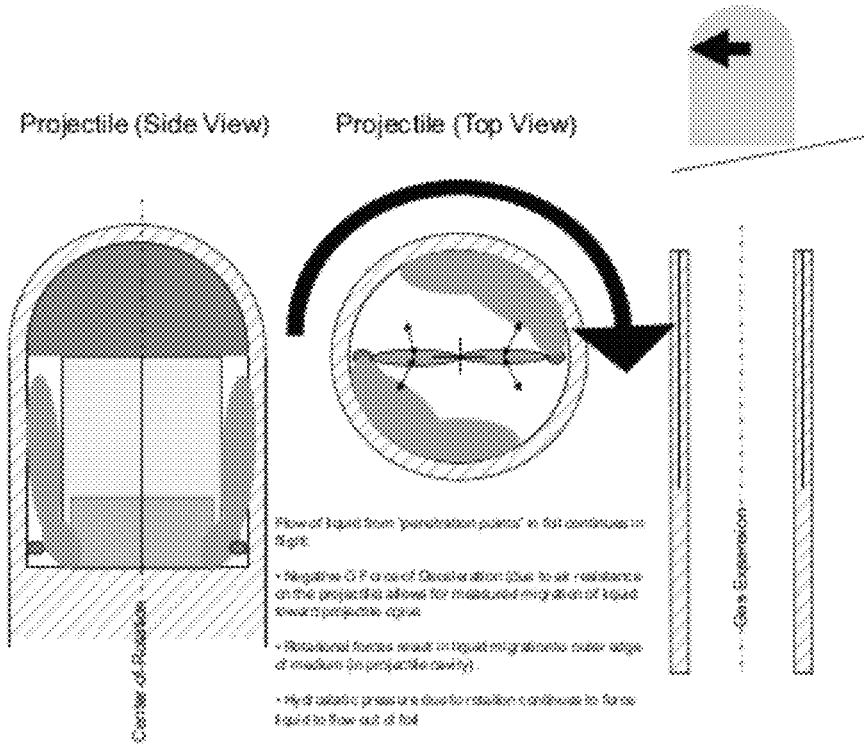
FIG. 6 is a representational diagram of the projectile of FIG. 2 just after it exits from the barrel of the weapon.

The liquid compartment continues to flow out through the openings in the foil as the projectile exits the barrel and continues to spin. The momentary deceleration, due to air resistance on the projectile, causes a measured migration of escaped liquid toward the projectile ogive, as shown in FIG. 6.

Figure 7:
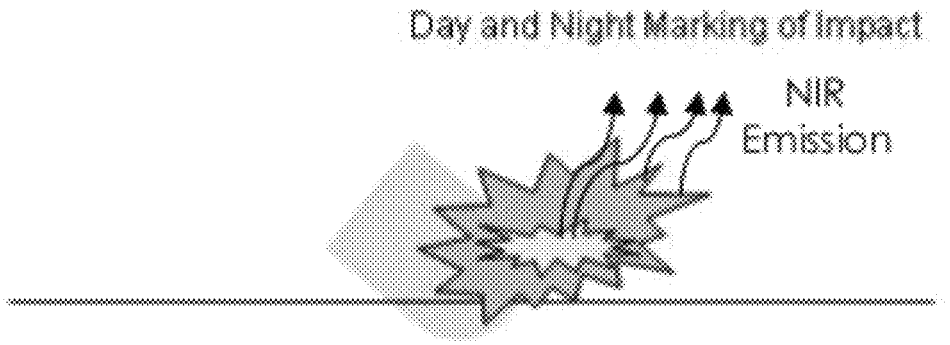
FIG. 7 is a representational diagram of the projectile of FIG. 2 as it strikes a target and bursts open, marking the target after impact.

Finally, when the projectile strikes a target, as shown in FIG. 7, the ogive bursts and releases both the mixed chemical components and the red dye powder, marking the point of impact of the target.

While embodiments of the present invention have been illustrated and described, it will be clear that the present invention is not limited to these embodiments only. Numerous modifications, changes, variations, substitutions and equivalents will be apparent to those skilled in the art, without departing from the spirit and scope of the present invention, as described in the claims.

What is claimed is:

1. A training projectile comprising a cartridge shell having a propulsion chamber with a propellant charge and a hollow projectile body inserted in the cartridge shell, the projectile body having a central axis of rotation and comprising:

(a) a projectile head designed to withstand the forces applied when the projectile is fired from a weapon and having a frangible ogive designed to burst when the projectile strikes a target, said ogive having a tubular portion and a head portion at an end of the tubular portion farthest from the cartridge shell;

(b) a plurality of first, frangible, compartments disposed in said tubular portion substantially symmetrically about the central axis of rotation of the projectile, and a cylindrical second compartment in said tubular portion surrounding said first compartments;

(c) a first marking agent for marking the position of the projectile impact with a target upon its release when the ogive has burst, said first marking agent comprising a plurality of first chemical components each disposed in a separate one of said first compartments, said first components being mixed and reacting chemically with each other when the first compartments are broken, causing the mixed components to react; and (d) a plurality of pellet masses, each disposed in a separate one of said first compartments together with a respective one of said first components, each mass being denser than said respective first component in said first compartment and serving to break the first compartment within which it resides due to the centrifugal forces on the projectile when the projectile is fired from a weapon.

2. The training projectile defined in claim 1, wherein the first chemical components are a liquid.

3. The training projectile defined in claim 1, wherein each said mass is pellet-shaped.

4. The training projectile defined in claim 3, wherein each said mass is a metal pellet.

5. The training projectile defined in claim 1, further comprising a carrier disposed in said second compartment surrounding the first compartments for receiving the mixed first chemical components when the first compartments are broken.

6. The training projectile defined in claim 5, wherein said first chemical components are a liquid are wherein the carrier comprises a dry powder.

7. The training projectile defined in claim 1, further comprising a second marking agent disposed in the ogive for making the position of the projectile impact upon its release when the projectile strikes the target and the ogive bursts.

8. The training projectile defined in claim 1, further comprising a third marking agent disposed in the ogive for marking the position of the projectile impact with a target upon its release when the projectile strikes the target and the ogive bursts, said third marking agent comprising a plurality of second chemical components each received in a separate compartment in the head, said second components being mixed and reacting chemically with each other, due to at least one of the initial acceleration and the centrifugal forces on the projectile, when the projectile is fired from a weapon, causing the mixed second components to substantially react by the time the projectile strikes the target.

9. The training projectile defined in claim 2, wherein the first chemical components react chemi-luminescently, thereby to mark the projectile position with light upon impact with a target.

10. The training projectile defined in claim 2, wherein the first chemical components react exothermically, thereby to thermally mark the projectile position upon impact with a target.

11. The training projectile defined in claim 7, wherein said second marking agent comprises a low density, fine, dry powder material disposed in a separate compartment in the ogive and designed to create a plume for marking the projectile position upon impact with a target when the ogive bursts.

12. The training projectile defined in claim 7, wherein said second marking agent is disposed in said head portion of said ogive.

* * * * *